US008960814B2

(12) United States Patent
Bergum et al.

(10) Patent No.: US 8,960,814 B2
(45) Date of Patent: Feb. 24, 2015

(54) LOCK SYSTEM WITH SPRING-LOADED LATCHING MECHANISM

(71) Applicant: Knaack LLC, Crystal Lake, IL (US)

(72) Inventors: Robert A. Bergum, Woodstock, IL (US); Steven J. Rogman, Crystal Lake, IL (US); Jose R. Rodriguez, Village of Lakewood, IL (US)

(73) Assignee: Knaack LLC, Crystal Lake, IL (US)

( * ) Notice: Subject to any disclaimer, the term of this patent is extended or adjusted under 35 U.S.C. 154(b) by 2 days.

(21) Appl. No.: 13/780,111

(22) Filed: Feb. 28, 2013

(65) Prior Publication Data

US 2014/0238996 A1 Aug. 28, 2014

(51) Int. Cl.

| | |
|---|---|
| ***E05B 53/00*** | (2006.01) |
| ***E05B 65/06*** | (2006.01) |
| ***E05B 65/00*** | (2006.01) |
| ***E05C 7/06*** | (2006.01) |

(52) U.S. Cl.

CPC ..... *E05B 65/06* (2013.01); *E05B 65/0003* (2013.01); *E05C 7/06* (2013.01)

USPC ..... 312/218

(58) Field of Classification Search

CPC ..... E05B 65/44; E05B 65/025; E05B 65/06; E05B 65/0003; Y10S 292/68; Y10S 292/18

USPC ..... 312/215, 222, 107.5, 109, 216–218; 292/137, 138, 163, 174, 57, 63, 64, 292/DIG. 15; 49/395

See application file for complete search history.

(56) References Cited

U.S. PATENT DOCUMENTS

| | | | | | |
|---|---|---|---|---|---|
| 946,764 | A | * | 1/1910 | Mochau | 292/146 |
| 1,036,442 | A | * | 8/1912 | Bullock | 312/107.5 |
| 1,109,086 | A | * | 9/1914 | Stuck | 312/107.5 |
| 1,140,343 | A | * | 5/1915 | Arens | 292/333 |
| 1,200,882 | A | * | 10/1916 | Scheaffer | 312/107.5 |
| 1,486,094 | A | * | 3/1924 | Lehman | 312/107.5 |
| 1,511,725 | A | * | 10/1924 | Hart | 312/324 |
| 1,557,138 | A | | 10/1925 | Oscar | |
| 1,602,264 | A | * | 10/1926 | Hutchison | 292/60 |
| 1,607,099 | A | * | 11/1926 | O'Connor | 312/324 |
| 1,661,370 | A | * | 3/1928 | Kaser | 312/222 |
| 1,702,385 | A | * | 2/1929 | Kaser | 312/222 |
| 1,709,915 | A | * | 4/1929 | Morris | 292/57 |
| 1,716,169 | A | * | 6/1929 | Hart | 312/217 |
| 1,720,021 | A | * | 7/1929 | Vance | 312/222 |

(Continued)

FOREIGN PATENT DOCUMENTS

| | | |
|---|---|---|
| FR | 364035 | 8/1906 |
| WO | 2012/170146 | 12/2012 |

OTHER PUBLICATIONS

International Search Report and Written Opinion for Int. App. No. PCT/US2013/063214, mailed Mar. 19, 2014.

*Primary Examiner* — Janet M Wilkens

(74) *Attorney, Agent, or Firm* — McDonnell Boehnen Hulbert & Berghoff LLP

(57) ABSTRACT

A storage cabinet including two storage compartments is disclosed. Each of the storage compartments has at least one door. The first compartment includes a locking mechanism and the second compartment includes a latching mechanism. The storage cabinet also includes a release mechanism for unlatching the latching mechanism that is accessible once the locking mechanism has been unlocked and at least one door of the first compartment has been opened.

18 Claims, 4 Drawing Sheets

(56) References Cited

U.S. PATENT DOCUMENTS

| | | | | | |
|---|---|---|---|---|---|
| 1,842,998 | A | * | 1/1932 | Rebischke et al. | 292/93 |
| 1,936,818 | A | * | 11/1933 | Bales et al. | 312/222 |
| 2,284,092 | A | * | 5/1942 | Johnson et al. | 312/222 |
| 2,516,527 | A | * | 7/1950 | Oltz | 410/142 |
| 2,987,356 | A | * | 6/1961 | Simpson, Jr. | 312/111 |
| 3,045,663 | A | * | 7/1962 | McDonnold | 126/190 |
| 4,875,745 | A | * | 10/1989 | Trulaske | 312/298 |
| 5,593,192 | A | * | 1/1997 | Stuchinsky | 292/207 |
| 6,428,125 | B1 | * | 8/2002 | Nakazawa et al. | 312/216 |
| 6,681,604 | B1 | * | 1/2004 | Samsel | 70/78 |
| 7,318,632 | B2 | * | 1/2008 | Bidinger et al. | 312/319.9 |
| 7,708,355 | B1 | * | 5/2010 | Bergesch | 312/222 |
| 8,240,786 | B2 | * | 8/2012 | Daino et al. | 312/324 |
| 8,250,811 | B2 | * | 8/2012 | Zijlstra | 49/394 |
| 2009/0090718 | A1 | | 4/2009 | Bridges et al. | |

* cited by examiner

LOCK SYSTEM WITH SPRING-LOADED LATCHING MECHANISM

FIELD OF THE INVENTION

This application relates to the field of storage cabinets or boxes for construction sites, and more particularly, to storage cabinets that can be locked to secure the contents.

BACKGROUND

Jobsite storage containers such as tool boxes and storage cabinets are used at construction job sites and similar locations for storing items such as tools, equipment and materials. The items stored in these storage containers typically are protected from theft by means of locks.

Such containers may have a number of separate compartments for allowing a contractor or tradesperson with options on the types of items stored in each compartment and the amount of security offered by each compartment. For example, a contractor may wish to secure the contents of a first compartment while having free access to the contents of a second compartment. In these instances, there is a need to provide a locking system that can lock each of the compartments if desired, but that can also allow one of the compartments to remain unlocked while the remaining compartment is locked.

Oftentimes, such storage containers are provided with a vertical center post to accommodate or house a locking mechanism. In situations where equipment such as televisions, monitors, and computers are contained and mounted in a compartment, it becomes important to incorporate a locking mechanism that does not obstruct the view of such components. Thus, there is a need to provide a locking mechanism in a manner that does not obstruct the view of the components housed in a compartment of the storage container.

These as well as other aspects and advantages will become apparent to those of ordinary skill in the art by reading the following detailed description, with reference where appropriate to the accompanying drawings. Further, it should be understood that the embodiments described in this summary and elsewhere are intended to illustrate the invention by way of example only.

SUMMARY

In one embodiment, the present application provides a storage container including a first compartment having at least one door moveable between an open position and a closed position. The first compartment also includes a locking mechanism for retaining the at least one door of the first compartment in the closed position. The locking mechanism is moveable between a locked position in which contents of the first compartment may not be accessed, and an unlocked position in which the contents of the first compartment may be accessed. The storage container also includes a second compartment having at least one door moveable between an open position and a closed position. The second compartment also includes a latching mechanism for retaining the at least one door of the second compartment in the closed position. The latching mechanism is moveable between a latched position in which contents of the second compartment may not be accessed, and an unlatched position in which the contents of the second compartment may be accessed. The storage container also includes a release mechanism for unlatching the latching mechanism. The release mechanism is accessible when the locking mechanism is in the unlocked position and the at least one door of the first compartment has been moved to the open position.

In yet another embodiment, a locking system for a storage container having a first compartment and a second compartment is disclosed. The locking system includes a locking mechanism for retaining at least one door of the first compartment in a closed position. The locking mechanism is moveable between a locked position in which contents of the first compartment may not be accessed, and an unlocked position in which the contents of the first compartment may be accessed. The locking system also includes a latching mechanism for retaining at least one door of the second compartment in a closed position. The latching mechanism is moveable between a latched position in which contents of the second compartment may not be accessed, and an unlatched position in which the contents of the second compartment may be accessed. The locking system also includes a release mechanism for unlatching the latching mechanism, the release mechanism being accessible when the locking mechanism is in the unlocked position and the at least one door of the first compartment has been moved to the open position.

A method for locking and unlocking a storage container having a first compartment and a second compartment is also provided. The method includes providing a locking mechanism for retaining at least one door of the first compartment in a closed position. The locking mechanism is moveable between a locked position in which contents of the first compartment may not be accessed and an unlocked position in which the contents of the first compartment may be accessed. The method also includes providing a latching mechanism for retaining at least one door of the second compartment in a closed position. The latching mechanism is moveable between a latched position in which contents of the second compartment may not be accessed, and an unlatched position in which the contents of the second compartment may be accessed. The method further includes providing a release mechanism for unlatching the latching mechanism, the unlatching mechanism being accessible when the locking mechanism is in the unlocked position and the at least one door of the first compartment has been moved from the closed position to an open position. The method also includes unlocking the locking mechanism to access the first compartment, and unlatching the latching mechanism after unlocking the locking mechanism to access the second compartment.

BRIEF DESCRIPTION OF THE FIGURES

Exemplary embodiments of the invention are described herein with reference to the drawings, in which.

DETAILED DESCRIPTION

The present application is directed to a jobsite storage cabinet or container that has two or more compartments with a locking system to secure the contents. The container may be used on the jobsite for housing a television, monitor, printer, keyboard, etc. in one compartment and for storing tools and equipment in another compartment. A latching mechanism secures the contents in an upper compartment of the container, and a separate locking mechanism secures the contents in a lower compartment of the container as well as the entire cabinet. The locking system of the container of the present application secures the upper compartment of the container by allowing the latching mechanism to be operated and unlatched only after the lower compartment doors are unlocked and opened. A separate key and lock is not required for the upper compartment. Further, the construction of the upper compartment doors and the latching mechanism is such that a vertical center post is not required, thereby providing an unobstructed view and access to the contents of the compartment.

Figure 1:
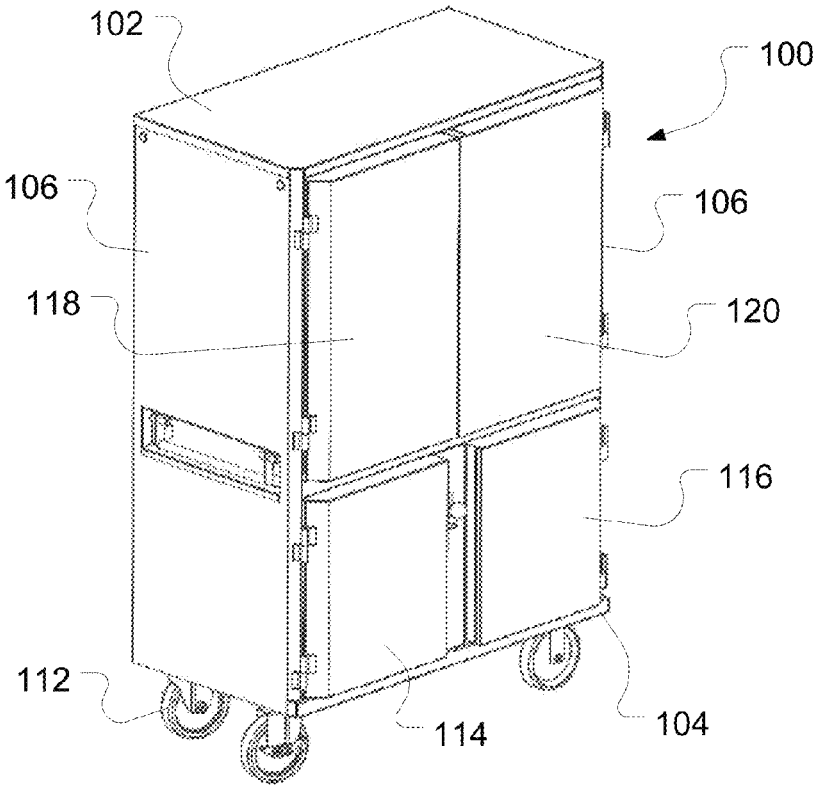
FIG. 1 is a perspective view of an embodiment of a storage container of the present application.

Turning now to the Figures, a storage cabinet or container 100 in accordance with the present application is shown in FIG. 1. The storage container 100 is shown in a closed and locked condition. The container 100 has top 102, bottom 104, and side walls 106. The container 100 has at least two compartments: a first compartment 108, shown in FIG. 2, which may be a lower compartment, and a second compartment 110, shown in FIG. 3, which may be an upper compartment. The first and second compartments 108, 110 may be separated by a horizontal member 111, which can be seen in FIG. 3, from which a wall (not shown) extends. The wall functions as the bottom wall of the upper compartment and the upper wall of the lower compartment. It should be understood that the first and second compartments 108, 110 may be configured to store tools and other equipment, as well as to accommodate a number of electronic components such as, for example, a flat screen television or monitor, a computer, a printer, a keyboard, and a mouse. The location of each component in the container 100 may vary depending upon the needs of the contractor or tradeperson. The container 100 may also be provided with a number of castors 112 adjacent the bottom wall 104 to allow the container to be moved from one location to another location.

Figure 2:
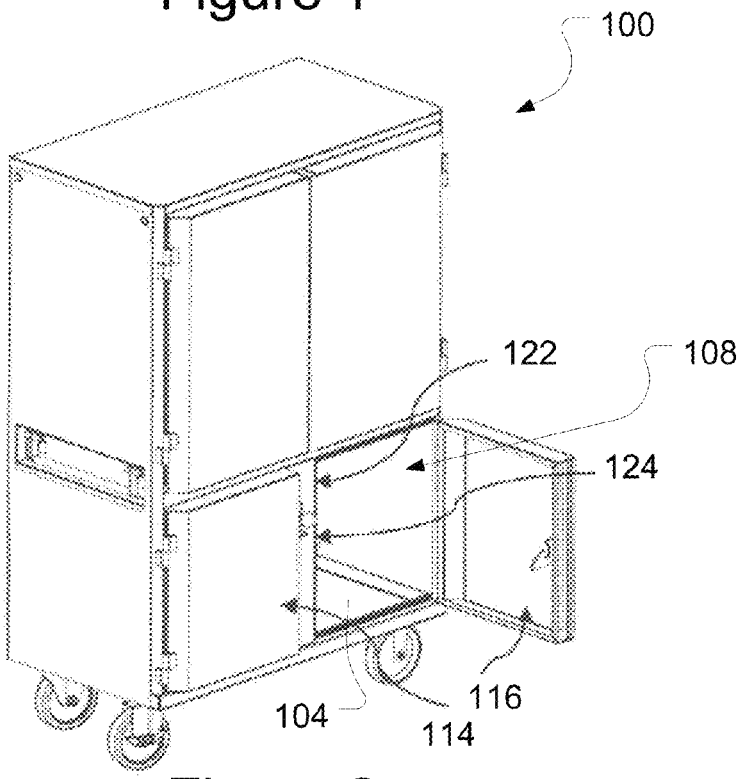
FIG. 2 is a perspective view of the storage container shown in FIG. 1 with the doors of a lower compartment open.

The first compartment 108 may include at least one door moveable between an open position and a closed position. As shown in FIGS. 1 and 2, the first compartment 108 has a first door 114 and a second door 116. The doors 114, 116 may be separated by a vertical center post 122. The container 100 further includes a locking mechanism 124 moveable between a locked position in which the contents of the container 100 may not be accessed and an unlocked position in which the contents of the container 100 may be accessed. In one embodiment, the locking mechanism 124 may be located on the vertical center post 122 of the first compartment 108. The locking mechanism 124 may take the form of Knaack LLC's WATCHMAN® IV lock system, which is the subject of U.S. Pat. No. 6,772,613, the disclosure of which is hereby incorporated by reference. When the locking mechanism 124 is in the locked position and the doors of the compartments are closed, access to the first compartment 108 as well as the second compartment 110 is prevented. Thus, the entire container 100 may be locked using the locking mechanism 124.

The second compartment 110 may include at least one door moveable between an open position and a closed position. As shown in FIGS. 1 and 2, the second compartment 110 has a first door 118 and a second door 120. The second compartment 110 further includes a latching mechanism 200 for retaining the doors 118, 120 of the second compartment 110 in the closed position. The latching mechanism 200 is moveable between a latched position in which the contents of the second compartment 110 may not be accessed, and an unlatched position in which the contents of the second compartment 110 may be accessed. The latching mechanism 200 is described in more detail below.

Figure 3:
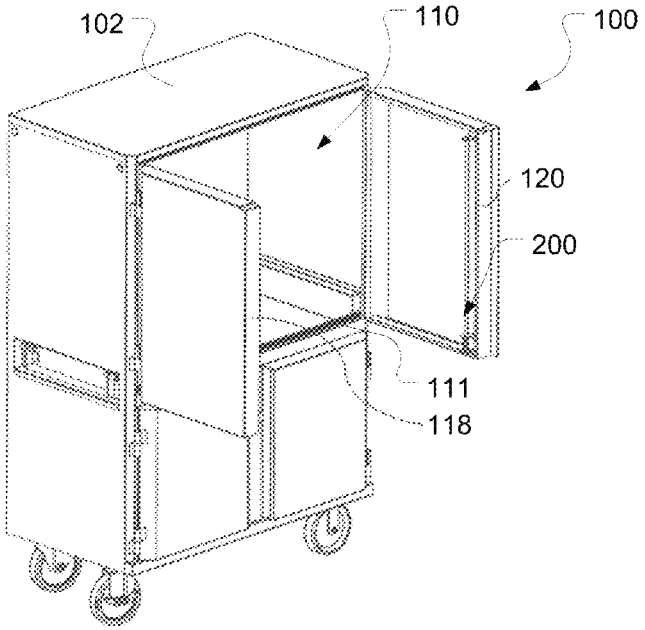
FIG. 3 is a perspective view of the storage container shown in FIG. 1 with the doors of an upper compartment open.

FIG. 3 depicts the doors 118, 120 of the container 100 in an open, unlatched condition. The latching mechanism 200 is carried on or mounted on door 120. However, it should be understood that the latching mechanism 200 could alternatively be mounted on door 118. To latch the doors 118, 120 of the second compartment 110, door 118 is closed first. Door 118 abuts against the horizontal member 111 and the top wall 102 of the container 100. The door 120 is then closed to abut against the horizontal member 111, the top wall 102, and door 118, and may be latched using the latching mechanism 200.

Figure 4:
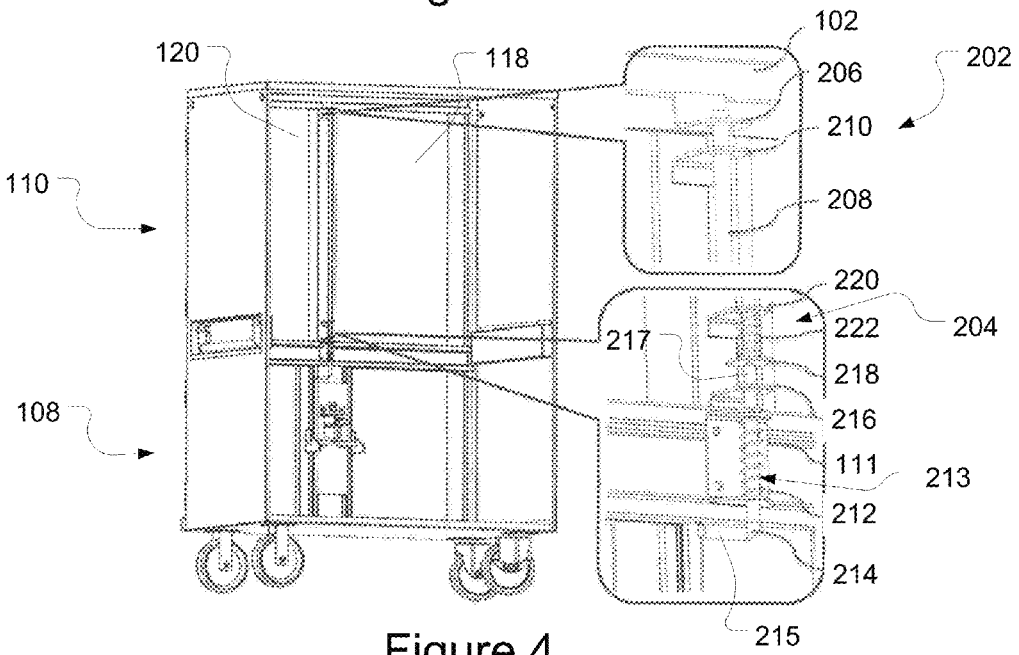
FIG. 4 is a rear view of the interior of the storage container shown in FIG. 1 including detailed views of the latching mechanism and the release mechanism.

FIG. 4 depicts the rear view of the interior of the container 100 when the doors 118, 120 are in the closed position. The latching mechanism 200 includes an upper portion 202 secured to a top of door 120 near the top 102 of the container 100, and a lower portion 204 secured at a bottom of the door 120, adjacent to the horizontal member 111.

The upper portion 202 of the latching mechanism 200 may include an upper catch 206 mounted to the top 102 of the container. A latch rod 208 extends through the upper catch 206 and along the length of the door 120 to the horizontal member 111. The upper portion 202 may also include an upper rod guide 210 mounted to the door 120 and aligned with the upper catch 206. As can be seen from FIG. 4, the upper catch 206 and the upper rod guide 210 are aligned so that the latch rod 208 may extend therethrough.

The lower portion 204 of the latching mechanism 200 includes a lower rod guide 220 through which the latch rod 208 may extend. The latch rod 208 is free to slide vertically within the two rod guides 210, 220. The lower end of the latch rod 208 is provided with a striker plate 218 and a spring 222 positioned on the latch rod 208 between the lower rod guide 220 and the striker plate 218. The latching mechanism further includes a lower catch 216, which is fixed on the door 120.

Adjacent the lower catch 216, a release mechanism is provided. The release mechanism comprises a spring-loaded clamp 212 that is fixed to the horizontal member 111 of the container 100. As will be described in detail below, the release mechanism functions to latch and unlatch the latching mechanism 200.

Figure 5:
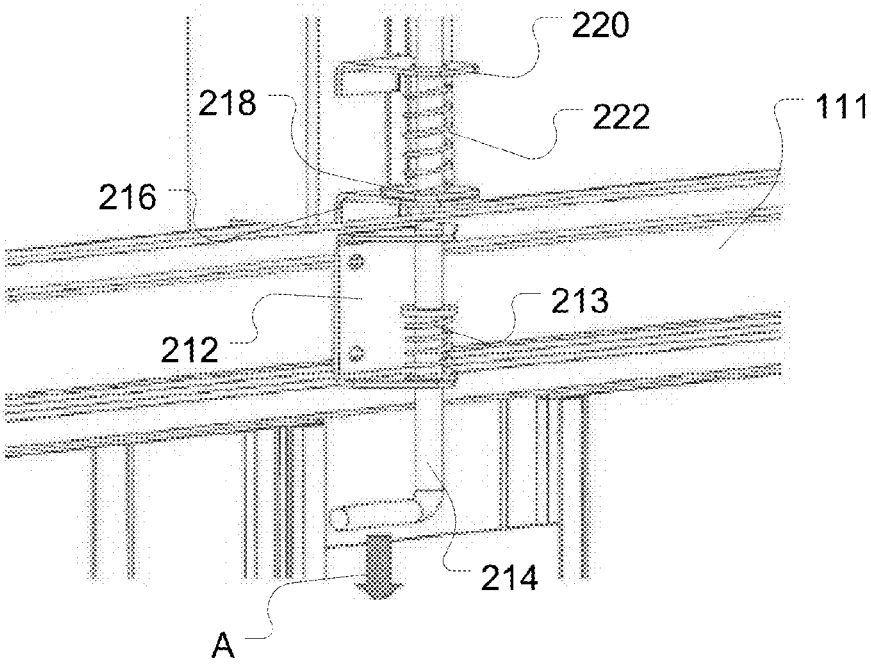
FIG. 5 depicts a detailed view of a portion of the latching mechanism and the release mechanism shown in FIG. 4, in the unlatched position.

In one embodiment, the release mechanism may further include a lever rod 214, as shown in FIGS. 4-5. The lever rod 214 has a first end 215 and a second end 217. The first end 215 of the lever rod is accessible from the first compartment 108, and the second end 217 of the lever rod interacts with the lower end of the latch rod 208 of the latching mechanism 200 to maintain the latching mechanism in the latched position. The spring 213 of the spring-loaded clamp 212 biases the lever rod to an upward position shown in FIG. 4. To enable this, the strength of the spring 213 of the spring-loaded clamp 212 is chosen to be greater than the strength of the spring 222 that is provided at the lower end of the latch rod 208. It should be understood that any other type of known release mechanism may be used to latch unlatch the latching mechanism 200.

In the latched position, the force and pressure of the spring 213 of the spring-loaded clamp 212 cause the lever rod 214 to be maintained in the raised position shown in FIG. 4. The lever rod 214 in turn pushes the striker plate 218 in the upward direction toward the top 102 of the container 100, causing the upper end of the latch rod 208 to pass through the upper catch 206. The engagement of the upper end of the latch rod 208 with the upper catch 206 and the lever rod 214 with the lower catch 216 keeps the doors 118, 120 in the latched position under the pressure of the spring 213 of the spring-loaded clamp 212.

In operation, to unlock the entire cabinet and unlatch the latching mechanism 200, a user must first unlock the locking mechanism 124. When the locking mechanism 124 is unlocked, the doors 114, 116 of the first compartment 108 may be opened and the contents of the compartment may be retrieved. Once the doors 114, 116 of the first compartment 108 are open, the release mechanism may be accessed and engaged by a user.

Figure 6:
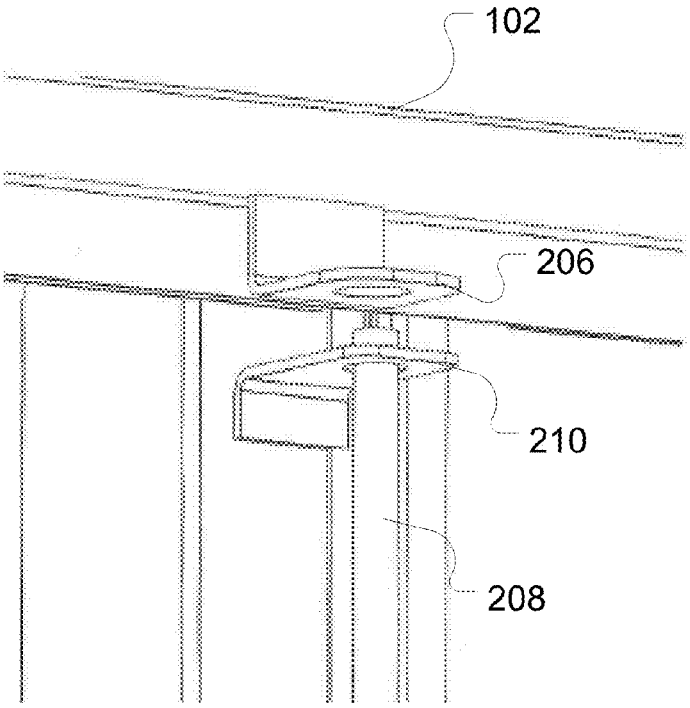
FIG. 6 depicts a detailed view of another portion of the latching mechanism shown in FIG. 4 in the unlatched position.

As shown in FIG. 5, the user pulls the lever rod 214 against the action of the spring 213 in the direction of arrow A to disengage the lever rod 214 from the lower catch 216. The action of the spring 222 and the weight of the latch rod 208 cause the latch rod 208 to descend until the striker plate 218 touches the lower catch 216. The lowering of the latch rod 208 results in the upper end of the latch rod clearing the upper catch 206, as shown in FIG. 6. Thus, actuating the lever rod 214 causes the upper end of the latch rod 208 and the upper end of the lever rod 214 to clear the upper catch 206 and the lower catch 216 respectively, thereby allowing the doors 118, 120 to be unlatched and moved to the open position. When the user releases the lever rod 214, the spring 213 of the spring-loaded catch 212 biases the lever rod back to the position of FIG. 4.

To re-latch the doors 118, 120, the user again pulls the lever rod 214 down in the direction of arrow A to allow the doors 118, 120 to shut. When the user releases the lever rod 214, the force of the spring 213 causes the lever rod 214 to move in an upward direction to engage with the lower catch 216, and the latch rod 208 to move in an upward direction so that the upper end of the latch rod 208 engages with the upper catch 206. With the latching mechanism latched, the locking mechanism 124 may be locked, thereby locking both compartments of the container 100.

It should be appreciated that the contractor may choose to lock the lower compartment while leaving the doors of the upper compartment opened. This would allow the equipment stored in the upper compartment to be used while allowing the contents of the lower compartment to be locked and secure. The locking system of the present invention allows for such a use.

Figure 7:
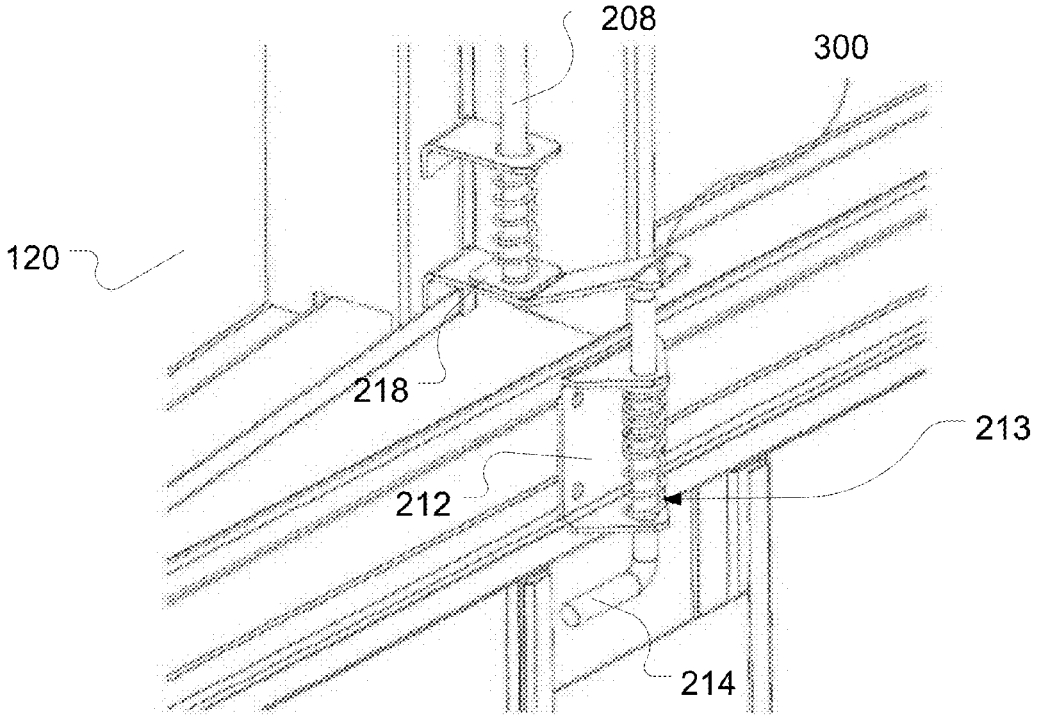
FIG. 7 shows another embodiment of the latching mechanism of the present application.

An alternative embodiment of the latching mechanism is shown in FIG. 7. The alternate embodiment includes a cam profiled lower catch 300, which comprises a lower catch with a cam profile extension. In this embodiment, as the user closes the door 120, the cam profile extension of the lower catch 300 automatically pushes the lever rod 214 in a downward direction. This eliminates the need for the user to again pull the lever rod 214 in the direction of arrow A when closing the upper doors 118, 120 in order to re-latch the latching mechanism 200. Once the cam profile extension of the catch 300 moves out of engagement with the lever rod 214, the lever rod 214 aligns with the hole defined in the lower catch 300 and moves upwardly therethrough. The force of the spring 213 of the spring-loaded catch 212 causes the lever rod 214 to push upward on the striker plate 218, thereby causing the latch rod 208 to reengage with the upper catch 206 and latch the latching mechanism 200. Thus, the cam profile lower catch 300 automatically latches the latching mechanism upon closure of the door of the compartment. Cam profile lower catch 300 can be removed to allow servicing of rod 208 and/or spring 222.

In a further alternate embodiment, the locking mechanism and the release mechanism could be provided to an upper compartment of a storage container with the latching mechanism being provided to a lower compartment. Such an embodiment would be within the scope of the present invention.

While the invention has been described in connection with certain embodiments, it will be understood that it is not intended to limit the invention to those particular embodiments. On the contrary, it is intended to cover all alternatives modifications, and equivalents included within the spirit and scope of the invention as defined by the appended claims.

The invention claimed is:

1. A storage container comprising:

a first compartment having at least one door moveable between an open position and a closed position, the first compartment further including a locking mechanism for retaining the at least one door of the first compartment in the closed position, the locking mechanism being moveable between a locked position in which contents of the first compartment may not be accessed and an unlocked position in which the contents of the first compartment may be accessed;

a second compartment including at least one door moveable between an open position and a closed position, the second compartment further including a latching mechanism for retaining the at least one door of the second compartment in the closed position, the latching mechanism being moveable between a latched position in which contents of the second compartment may not be accessed and an unlatched position in which contents of the second compartment may be accessed; and a release mechanism for unlatching the latching mechanism, the release mechanism being accessible when the locking mechanism is in the unlocked position and the at least one door of the first compartment has been moved to the open position;

wherein the release mechanism includes a spring loaded clamp, the spring loaded clamp being operable to maintain the latching mechanism in the latched position.

2. The storage container of claim 1 wherein the release mechanism further comprises a lever rod mounted on an inside surface of the container, the lever rod having a first end and a second end, the first end being accessible from the first compartment, and the second end interacting with a portion of the latching mechanism to maintain the latching mechanism in the latched position.

3. The storage container of claim 1 wherein the latching mechanism is carried on the at least one door of the second compartment.

4. The storage container of claim 1 wherein the latching mechanism further comprises a latch rod extending along the at least one door of the second compartment, the latch rod being moveable between an unlatched position in which the contents of the second compartment may be accessed and a latched position in which the contents of the second compartment may not be accessed.

5. The storage container of claim 4 wherein the latching mechanism further comprises at least one catch fixed to the container adjacent a top of the at least one door of the second compartment for maintaining the latch rod in the latched position.

6. The storage container of claim 5 wherein, in the latched position, the spring-loaded clamp pushes the latch rod in an upward direction through the at least one catch.

7. The storage container of claim 5 wherein, in the unlatched position, the spring-loaded clamp allows the latch rod to be disengaged from the at least one catch.

8. The storage container of claim 1 wherein the first compartment and the second compartment are separated by a horizontal member.

9. The storage container of claim 1 wherein the latching mechanism comprises an upper portion secured to a top of the at least one door of the second compartment and a lower portion secured to a bottom of the at least one door of the second compartment, adjacent the horizontal member.

10. The storage compartment of claim 9 wherein the release mechanism further comprises a lever rod mounted on an inside surface of the container, the lever rod having a first end and a second end, the first end being accessible from the first compartment and the second end interacting with the lower portion of the latching mechanism to maintain the latching mechanism in the latched position.

11. The storage compartment of claim 1 wherein the first compartment comprises a first door and a second door being separated by a vertical post, and wherein the locking mechanism is mounted on the vertical post.

12. The storage container of claim 1 wherein the second compartment comprises a first door and a second door, and wherein the latching mechanism is carried on the first door or the second door.

13. The storage compartment of claim 1 wherein the first compartment is a lower compartment and the second compartment is an upper compartment.

14. The storage container of claim 1 wherein the latching mechanism includes a cam profiled lower catch that automatically latches the latching mechanism upon closure of the at least one door of the second compartment.

15. The storage container of claim 1 wherein, in the locked position and with the door of the second compartment in the closed position, the locking mechanism prevents access to the contents of the second compartment.

16. A locking system for a storage container having a first compartment and a second compartment, the locking system comprising:

a locking mechanism for retaining at least one door of the first compartment in a closed position, the locking mechanism being capable of being moveable between a locked position in which contents of the first compartment may not be accessed and an unlocked position in which the contents of the first compartment may be accessed;

a latching mechanism for retaining at least one door of the second compartment in a closed position, the latching mechanism being capable of being moveable between a latched position in which contents of the second compartment may not be accessed and an unlatched position in which the contents of the second compartment may be accessed; and a release mechanism for unlatching the latching mechanism, the release mechanism being capable of being accessible when the locking mechanism is in the unlocked position and the at least one door of the first compartment has been moved to the open position; and wherein the latching mechanism further comprises a latch rod capable of extending along the at least one door of the second compartment, the latch rod being capable of being moveable between an unlatched position in which the contents of the second compartment may be accessed and a latched position in which the contents of the second compartment may not be accessed.

17. The locking system of claim 16 wherein the release mechanism further comprises a lever rod mountable on an inside surface of the container, the lever rod having a first end and a second end, the first end capable of being accessible from the first compartment, and the second end interacting with a portion of the latching mechanism to maintain the latching mechanism in the latched position.

18. A method for locking and unlocking a storage container having a first compartment and a second compartment, the method comprising:

providing a locking mechanism for retaining at least one door of the first compartment in a closed position, the locking mechanism being moveable between a locked position in which contents of the first compartment may not be accessed and an unlocked position in which the contents of the first compartment may be accessed;

providing a latching mechanism for retaining at least one door of the second compartment in a closed position, the latching mechanism being moveable between a latched position in which contents of the second compartment may not be accessed and an unlatched position in which the contents of the second compartment may be accessed;

providing a release mechanism for unlatching the latching mechanism, the release mechanism including a spring loaded clamp, the spring loaded clamp being operable to maintain the latching mechanism in the latched position, and the release mechanism being accessible when the locking mechanism is in the unlocked position and the at least one door of the first compartment has been moved from the closed position to an open position;

unlocking the locking mechanism to access the first compartment; and unlatching the latching mechanism after unlocking the locking mechanism to access the second compartment.

* * * * *